US005495800A

United States Patent [19]

Weissbein et al.

[11] Patent Number: 5,495,800

[45] Date of Patent: Mar. 5, 1996

[54] ENHANCED APPLICATION PRINTING INK HAND PROOFING DEVICE

[75] Inventors: Leonard Weissbein, Bridgewater, N.J.; James F. Queroli, Philadelphia, Pa.

[73] Assignee: Cavanagh Corporation, Flemington, N.J.

[21] Appl. No.: 411,582

[22] Filed: Mar. 29, 1995

[51] Int. Cl.[6] ..... B41F 9/00

[52] U.S. Cl. ..... 101/329; 101/405

[58] Field of Search ..... 101/328, 329, 101/330, 331, 405, 406; 401/48, 146, 150, 196, 197, 208, 218

[56] References Cited

U.S. PATENT DOCUMENTS

| | | | |
|---|---|---|---|
| 2,763,206 | 9/1956 | Alessi, Jr. | 101/329 |
| 2,805,436 | 9/1957 | Christensen et al. | 15/132 |
| 4,301,730 | 11/1981 | Heurich et al. | 101/348 |
| 4,366,755 | 1/1983 | Yoshimura | 101/329 |
| 4,422,789 | 12/1983 | Charney | 401/218 |
| 4,630,952 | 12/1986 | Elbaum | 401/48 |
| 4,817,526 | 4/1989 | Winston | 101/329 |
| 5,072,669 | 12/1991 | Weisbrod et al. | 101/142 |

FOREIGN PATENT DOCUMENTS

| | | | |
|---|---|---|---|
| 0551947 | 6/1932 | Germany | 101/329 |

OTHER PUBLICATIONS

Interflex Corporation Flexo Handproofer Sales Sheet, Date Unknown.

*Primary Examiner*—Christopher A. Bennett
*Attorney, Agent, or Firm*—Kenneth P. Glynn

[57] ABSTRACT

The present invention is directed to an anilox roll printing ink hand proofing device which includes a base frame having an elongated member adapted to receive a handle and sideframes; a handle connected to the base frame, sideframes on the base frame, a nesting subframe for an anilox roll, an anilox roll, a doctor blade on the nesting subframe, blade adjustment capabilities, and a transfer roll. The handle includes a hollow elongated member and contains a pressure rod in the hollow elongated member. There is also a pressure rod adjustment mechanism connected to the pressure rod and to the handle so as to indirectly change the pressure on the anilox roll against a transfer roll. Finally, there is a pressure rod release mechanism attached to one of the rod, the pressure rod adjustment mechanism and the handle so as to act as a quick release to release the pressure between the anilox roll and the transfer roll without affecting the pressure rod adjustment mechanism setting.

18 Claims, 3 Drawing Sheets

ENHANCED APPLICATION PRINTING INK HAND PROOFING DEVICE

FIELD OF THE INVENTION

1. Field of the Invention

The present invention relates to enhanced application printing ink hand proofing devices, and, more specifically, such devices used to create proofing sheets with printing inks which have more uniform applications which are more reliable, reproducible thus heretofore achieved. These devices rely upon a unique blade arrangement and a unique structural arrangement which not only yields reliable, repeatable, enhanced applications but may be quick released for cleaning and may even be cleaned without affecting or changing a pressure setting.

2. Information Disclosure Statement

Various printing press systems and rolls have been developed over decades and even centuries. The anilox roll is a special type of printing roll such as is described in U.S. Pat. Nos. 5,072,669 and 4,301,730. These enable a printer to obtain extremely high quality printing with controlled thickness, distribution and color quality products.

U.S. Pat. No. 5,072,669 describes a printing press inking unit with at least one pitted roll cooperating with two doctor blades offset from each other in the circumferential direction of the pitted roll and preferably carried on a mount so as to define an ink chamber between them into which the pitted roll extends, the wear of the doctor blade removing debris from the pitted roll is reduced if there is a forechamber outside the blade which is upstream in terms of the direction of rotation of the pitted roll, such roll dipping into such forechamber.

U.S. Pat. No. 4,817,526 describes a printing device for printing a continuous strip of indicia. The printing device comprises a housing defining a handle and an operating end portion. The operating end portion defines a print wheel cavity adapted to carry a print wheel with an outer circumferential printing surface for rotation about a wheel axis. An inking assembly comprising an ink housing and an inking roller is moveable between a first forward position where the inking roller is in contact with the print wheel and a second retracted position where the inking roller is spaced from the print wheel. A spring is mounted in the housing which is adapted to urge the inking roller toward the first forward position and releasable retaining structure positioned on the ink housing is adapted to hold the inking assembly in the second retracted position.

U.S. Pat. No. 4,630,952 describes a design painting device for painting wallpaper-like patterns on walls and other flat surfaces. The device comprises a container for holding paint as well as a series of feeder rollers for feeding paint onto the embossed surface of a pattern roller. Additional means, independent of the pattern roller, provides turning power to rotate the feeder rollers at the same linear speed as the pattern roller.

U.S. Pat. No. 4,422,789 describes a fluid applicator with a feeder roller. The feeder roller is a fluid dispenser roller. A fluid applicator includes a fluid applicator roller engaged with a fluid dispersing roller. The fluid dispersing roller includes a pair of helical fluid dispersing troughs which receive fluid from a pump which is operated by a control located on a handle of the fluid applicator.

U.S. Pat. No. 2,805,436 describes a paint applicator using dual rollers.

Interflex Corporation of Fairforest, S.C. currently markets a flexo handproofer which utilizes a quick release frame for easy cleaning, but does not teach or suggest the combined pressure rod adjustment means and pressure rod release means contained within the handle as in the present invention, nor does it include bearings or other features set forth in the preferred embodiments of the present invention as claimed herein.

The above prior art relates generally to anilox rollers, to printing press inking units and to liquid applicators. While some show dual roller structures, none teaches or suggests the unique structural combination utilized in the present invention hand proofing device.

SUMMARY OF THE INVENTION

The present invention is directed to an anilox roll printing ink hand proofing device which includes a base frame having an elongated member adapted to receive a handle and sideframes; a handle connected to the base frame, sideframes on the base frame, a nesting subframe for an anilox roll, an anilox roll, a doctor blade on the nesting subframe, blade adjustment capabilities, and a transfer roll. The handle includes a hollow elongated member and contains a pressure rod in the hollow elongated member. There is also a pressure rod adjustment mechanism connected to the pressure rod and to the handle so as to indirectly change the pressure on the anilox roll against a transfer roll. Finally, there is a pressure rod release mechanism attached to one of the rod, the pressure rod adjustment mechanism and the handle so as to act as a quick release to release the pressure between the anilox roll and the transfer roll without affecting the pressure rod adjustment mechanism setting.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Anilox roll printing is broadly used and well known in the printing industry. There have emerged very fine printing techniques, such as flexographic printing, wherein fine print, color exacting, rapidly produced product is achieved. Ink manufacturers custom blend ink colors and also market standard color lines with high standards of quality essential to their success. In order to standardize colors and to assure high quality, proofs are prepared by using small manual rollers called hand proofers, and are then used to check colors, e.g. by computerized spectrophotometer analysis. The color reflectance provides the unique spectrum analysis to allow the ink manufacturers to have very good reproducibility of proof sheets for a given ink lot. Without this, there is no reliable base or control analysis on which to reproduce reliable results.

Flexographic printing ink has pigments which are sized at the submicron level and relies upon ultraviolet light for curing. The elimination of evaporating solvents is a significant advance for the environment and the ability to confidently reproduce color and quality is essential to the continued success of these inks. The flexographic inks are of specific viscosity ranges, e.g., about 100 to about 5,000 cps, e.g. 400 to 4,000 cps, and film thicknesses are typically below 1 mil., e.g. 1 to 15 microns. Thus, reproducability of thickness and quality becomes more difficult at the same time that it becomes more important.

The existing hand proofing devices evince difficult reproducability with flexographic inks, for example, and color variations for a given control lot can be seen with the human eye. Thus, the prior art hand proofers may be reliable to ±5% or worse and typically have variations of as much as 20% or more. In other words, variations on the spectrophotometric analysis for the same lot using a prior art hand printer has been found to be over 3% and typically 5 to 8%. On the other hand, the present invention device, using the very same lot of ink, has been found to reduce the variation to below 3%, i.e. not discernable by the human eye. This makes the control ink run and subsequent lot ink run comparisons much more accurate and reliable.

Figure 1:
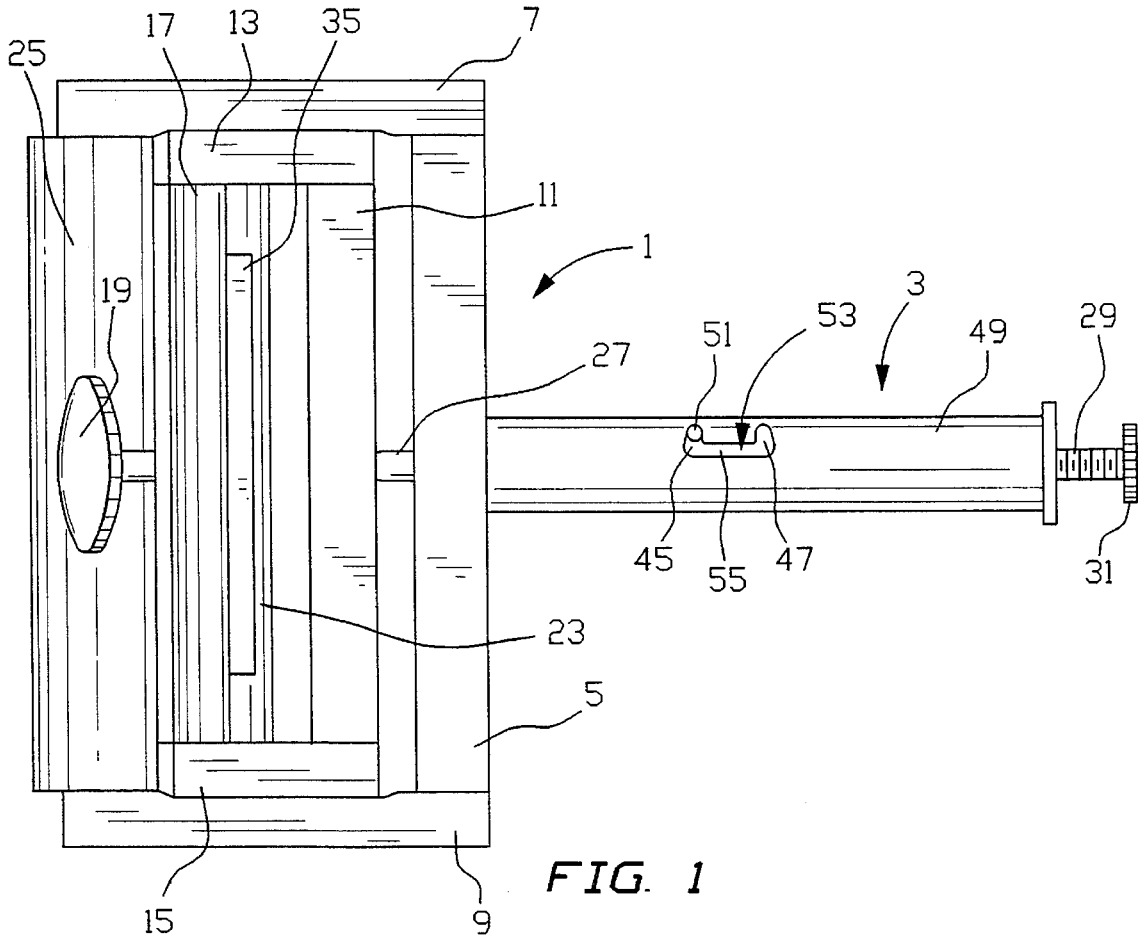
FIG. 1 shows a top view of a present invention hand proofing device and FIG. 2 shows a side view thereof.
Figure 2:
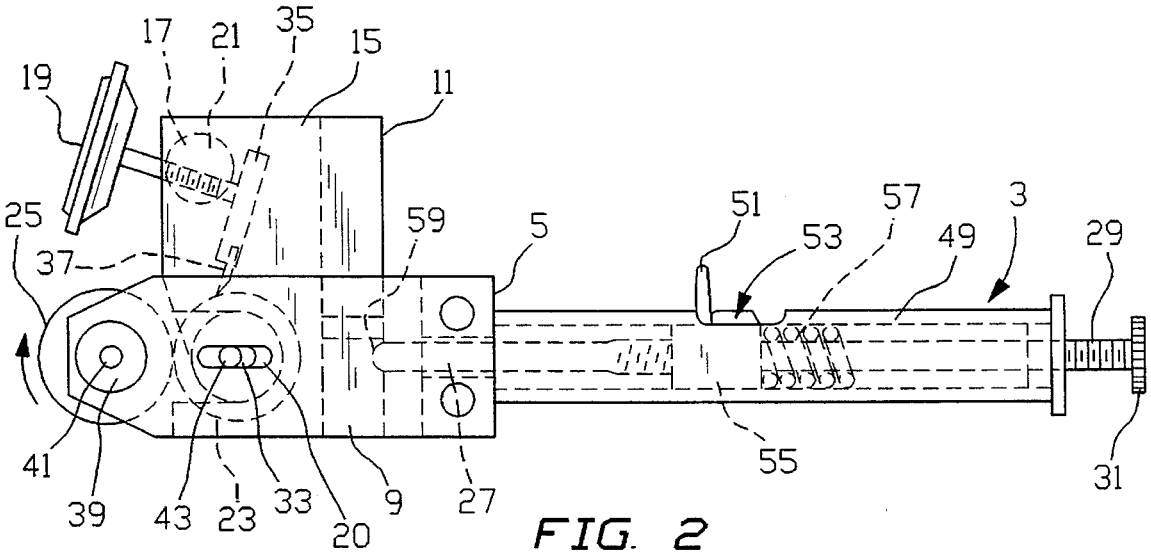

FIG. 1 shows a top view and FIG. 2 shows a side view of a present invention anilox roll printing ink hand proofing device 1 with handle 3, base frame 5 and sideframes 7 and 9. The base frame 5 has a hole therethrough for penetration therethrough of pressure rod 27 and includes means for attaching handle 3 to it, e.g. threading (non shown). The sideframes 7 and 9 extend as shown and are adapted to receive a subframe and a transfer roll. Connected to sideframes 7 and 9 of base frame 5 is an anilox roll nesting subframe 11. This has sides 13 and 15, as well as a blade adjustment means holder 17. Note that the base frame sideframes 7 and 9 are thinner at the subframe 11 area so as to provide a section wherein subframe 11 may be moved back and forth but not completely backward or all the way forward. In other words, the sideframes 7 and 9 have been formed so as to assist in holding the subframe assembly in place. Additionally, subframe sides 13 and 15 could be grooved and sideframes 7 and 9 could be likewise grooved in a complementary fashion so that they fit into one another and so that the subframe assembly may slide back and forth without torquing. However, as illustrated in FIG. 2, there is an indentation 59 which receives pressure rod 27 and this also helps maintain proper alignment of the subframe 11 within base frame sideframes 7 and 9.

Anilox roll 23 is located within nesting subframe 11 and its pins such as anilox roll pin 43 extends from anilox roll 23 to extend at least partially into or even through an elongated set of orifices, one on each of sideframes 7 and 9, illustrated by elongated orifice 20 shown in FIG. 2. Anilox roll 23 is pressed against transfer roll 25 and pressure rod 27 maintains the pressure against nesting subframe 11 so that it forces anilox roll 23 against transfer roll 25 at a predetermined pressure resulting from rotation of pressure rod adjustment means 29, by rotating gripping dial 31, for example, clockwise to tighten and counterclockwise to untighten. Pressure rod adjustment means 29 is threaded and fits into pressure rod release means collar 55. Thus, the collar 55 is held in a position as shown so that as pressure rod adjustment means 29, when it is rotated downwardly or upwardly and is directly connected to pressure rod 27, ending in indentation 59 of subframe 11, causes the subframe 11 and anilox roll 23 to move accordingly.

Connected to subframe blade adjustment means holder 17 is blade adjustment means 19, in this case, a rotatable dial which includes a screw 21 which is threaded and passes through a screw tapped orifice in holder 17. At the end of screw 21 is blade holder 35 and blade 37. A critical feature of the present invention is that blade 37 be set up as a follower-type doctor blade so that ink may be located behind the doctor blade and the blade will both act as a wiping blade and as a distributing fountain. By rotation of blade adjustment means 19, for example clockwise to go upwardly away from subframe 11 and counterclockwise to go downwardly toward it, blade 37 may be adjusted against the surface of anilox roll 23 accordingly. In this device 1, the anilox roll 23 has bearings such as bearings 33 so as to facilitate its ease of rolling. It has been discovered that these bearings support the roll pins to promote smoother drawdowns and to prevent slipping, sliding and skipping of the transfer roll against slick plastic film substrates. Thus, the bearings are adapted to fit over the anilox roll pins such as pin 43 and are contained within a washer-type fitting which nests within the subframe 11. This will be further illustrated with respect to FIGS. 3 and 4.

The sideframes 7 and 9 each also include a transfer roll pin holding insert such as insert 39. This is adapted to receive the transfer roll pins such as pin 41, as shown.

Referring again to handle 3 and hollow member 49, there is a pressure rod release means 53 which includes a cut-out as shown, pressure rod release means collar 55 and pressure rod release means lever 51, as well as spring 57. Spring 57 is strategically located and held in place so as to push collar 55 and therefore pressure rod adjustment means 29 and pressure rod 27 against the subframe 11. When pressure rod release means lever 51 is located in its first position, shown as first position 45, the pressure rod 27 is engaged with subframe 11 and, therefore under pressure. The pressure rod release means lever 51 may be pushed clockwise then away from the subframe 11 and then counterclockwise (in other words, in a "U" direction), so as to move from a first position 45 to second position 47. In second position 47, pressure rod 27 is totally disengaged from subframe 11 and subframe 11 may be easily removed or rotated for cleaning of the anilox roll 23 without affecting, altering or changing in any way the setting and therefore the pressure relationship which will be re-achieved when pressure rod release means lever 51 is moved from second position 47 back to first position 45. Thus, a user achieves reproducible results repeatedly from lot to lot by using the present invention hand proofer because the following doctor blade acts both as a wiper and as a fountain to distribute the ink evenly and at a very precise coating level, the quick release mechanism, that is the pressure rod release means 53 enables a user to maintain the exact setting without ever touching or changing it. Thus, reproducability and high quality which has not previously been achievable is achieved using the present invention hand proofing device.

Figure 3:
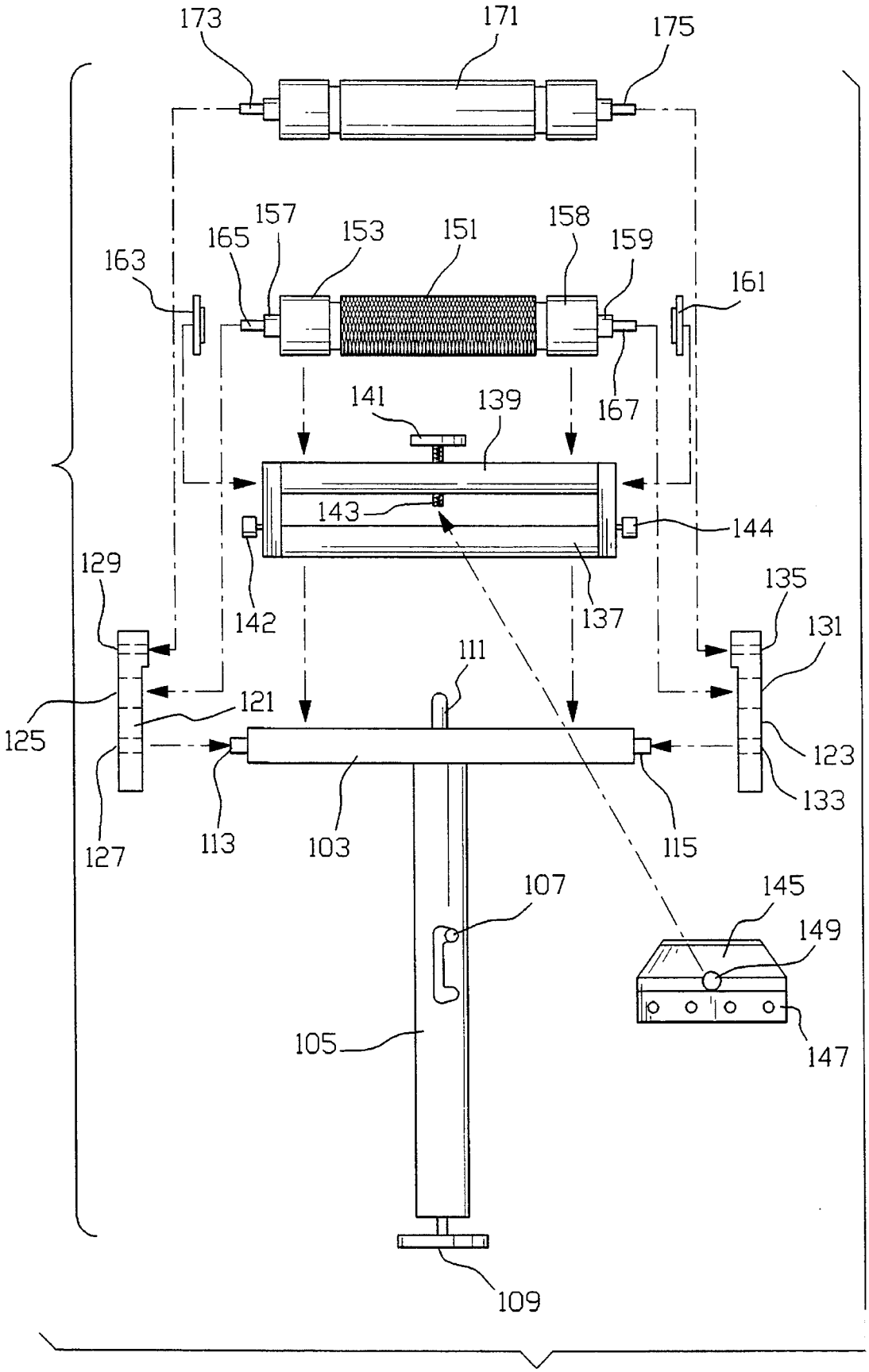
FIG. 3 shows a front, exploded view of an alternative embodiment present invention anilox roll printing ink hand proofing device.

Referring now to FIG. 3, there is shown a top exploded view of an alternative embodiment present invention anilox roll printing ink hand proofing device 101. Here, base frame 103 is connected to handle 105, which includes pressure rod adjustment means 109 and pressure rod release means 107. Pressure rod 111 is connected to the pressure rod adjustment means 109 and the pressure rod release means 107 and passes through base frame 103, as shown. Base frame 103 also includes attachment members 113 and 115 for attaching sideframes 121 and 131 thereto. Thus sideframe 121 includes attachment orifice 127, anilox roll pin elongated orifice 125 and transfer roll pin receiving orifice 129.

Likewise, sideframe 123 includes attachment orifice 133 and anilox roll pin elongated orifice 131 and transfer roll pin receiving orifice 135. The dotted lines throughout the figure show the connections of the exploded parts as they would be assembled.

Subframe 137 includes attachment means 142 and 144 for its sidewalls and has a top member 139 for holding blade adjustment means 141. This includes a screw member 143 which passes through top member 139 to which blade holder 145 is attached at threaded locking orifice 149. Attached to blade holder 145 is blade 147. Anilox roll 151 has sideroll sections 153 and 158 and bearing receivers 157 and 159 with bearings 163 and 161, as shown. Pins 165 and 167 pass into elongated orifices 125 and 131, described below, respectively. Transfer roll 171 with pins 173 and 175 will be assembled against anilox roll 151 with the pins 173 and 175 respectively passing into holding orifices 129 and 135 in sideframes 121 and 123.

Figure 4:
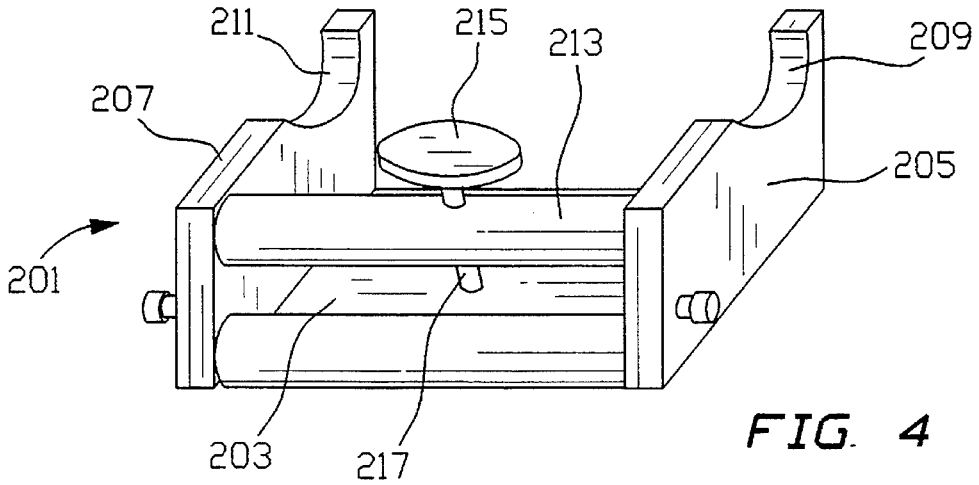
FIG. 4 shows an oblique front view of an anilox roll nesting subframe used in a present invention hand proofing device; and, FIG. 5 shows an oblique front view of a base frame and handle arrangement used in a present invention hand proofing device.

FIG. 4 shows a front oblique view of a basic subframe 201 (without the blade and blade holder). There is included a base frame bottom 203, base frame sides 205 and 207 with cut-outs 209 and 211 respectively for receiving the bearings or rings of an anilox roll. Top elongated member 213 is connected to base frame sides 205 and 207 and has a threaded orifice throughwhich screw 217 of blade adjustment means 215 passes through. As with FIG. 3, FIG. 4 is shown to present a different view to render the present invention more readily understood and may have slight variations from figure to figure as they do represent, in some cases, slightly different embodiments.

Figure 5:
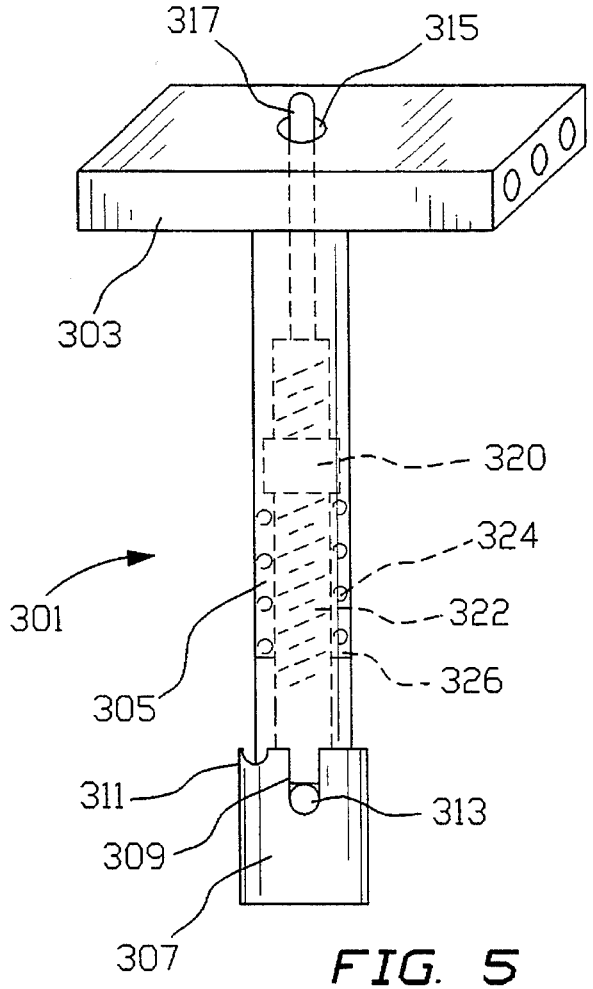

FIG. 5 shows an alternative present invention front perspective view of a base frame and handle assembly shown as generally as assembly 301. There is included a base frame plate 303 with an open orifice 315, throughwhich pressure rod 317 passes through. Pressure rod 317 is connected to a threaded shaft 322 which, itself, is screwed into collar or yoke 320. The yoke 320 is able to move up and down but will not rotate due to pins, cerations or other arrangements within hollow handle member 305. Springs 324 push collar 320 downwardly towards base frame 303 and pull on handle cap 307. Handle cap 307 has a short cut-out 311 and a long cut-out 309 and handle 307 may be pulled away from base frame 303 (compressing spring 324) so that it may be rotated from long cut-out 309 to short cut-out 311 when handle 307 is positioned as shown in the figure, rod 317 would be pressure positioned against an anilox roll nesting subframe such as is shown in FIG. 4. When handle 307 is pulled away, rotated and released onto short cut-out 311, then pressure rod 317 would be located away from and not apply pressure to a subframe. Thus, it can be seen that the means for adjusting the pressure of a pressure rod as well as the release means may take different forms as illustrated by comparison between what is shown in FIGS. 1 and 2 and in FIG. 5.

Obviously, numerous modifications and variations of the present invention are possible in light of the above teachings. It is therefore understood that within the scope of the appended claims, the invention may be practiced otherwise than as specifically described herein.

What is claimed is:

1. An anilox roll printing ink hand proofing device, which comprises:

a. a base frame, having an elongated member adapted to receive a handle and sideframes;

b. a handle connected to said base frame, said handle including a hollow elongated member and containing a pressure rod in said hollow elongated member, and including pressure rod adjustment means connected to said pressure rod and to said handle so as to be movable relative to one of said rod and said handle so as to adjust a position of said rod relative to said handle for the purpose of at least indirectly changing pressure on an anilox roll against a transfer roll, and including pressure rod release means attached to one of said rod, said pressure rod adjustment means and said handle, said pressure rod release means having a first, fixed position wherein said pressure rod is in an engaged location applying pressure, at lease indirectly, to an anilox roll, and having a second, different fixed position wherein said pressure rod is in a disengaged location wherein no pressure is applied to an anilox roll;

c. sideframes located at opposite ends of said base frame elongated member and adapted to receive an anilox roll and a transfer roll so that at least one of said anilox roll and said transfer roll is movable relative to one another;

d. an anilox roll nesting subframe, which is adapted to receive and rotatably mount an anilox roll therein, and which is adapted to movably mount within said sideframes and against said pressure rod so as to be moveable by said pressure rod so as to force an anilox roll against a transfer roll at predesired pressure levels;

e. an anilox roll rotatably nested in said subframe and having end pins extending from said anilox roll and located within said sideframes;

f. a doctor blade adjustively mounted on said subframe and located against said anilox roll;

g. blade adjustment means connected to at least one of said blade and said subframe and adapted to adjust a blade level; and, h. a transfer roll rotatably mounted within said sideframes and against said anilox roll.

2. The device of claim 1 wherein said anilox roll has end shafts adapted to fit into said subframe.

3. The device of claim 2 wherein said end shafts include bearings and bearing rings.

4. The device of claim 1 wherein said handle is a hollow tube-like elongated member and said pressure rod and a spring are located therein and said rod is spring biased with pressure on said pressure rod in a direction toward said frame.

5. The device of claim 4 wherein said rod is connected to said pressure rod adjustment means so that said means may be rotated in a first direction to move said rod away from said base frame and may be rotated in an opposite direction to move said rod toward said base frame.

6. The device of claim 4 wherein said anilox roll is mounted within expanded slots of said sideframes so as to be moveable therein along a line parallel to a line of movement of said pressure rod.

7. The device of claim 5 wherein said anilox roll is mounted within expanded slots of said sideframes so as to be moveable therein along a line parallel to a line of movement of said pressure rod.

8. The device of claim 4 wherein at least one of said side frames is removably attached to said base frame.

9. The device of claim 5 wherein at least one of said side frames is removably attached to said base frame.

10. The device of claim 1 wherein said anilox roll is mounted within expanded slots of said sideframes so as to be moveable therein along a line parallel to a line of movement of said pressure rod.

11. The device of claim 1 wherein at least one of said side frames is removably attached to said base frame.

12. The device of claim 1 wherein said doctor blade is set against said anilox roll at a predetermined angle to constitute a following blade so as to function both as a wiping blade and as a flood coat controller.

13. The device of claim 12 wherein said anilox roll has end shafts adapted to fit into said subframe.

14. The device of claim 13 wherein said end shafts include bearings and bearing rings.

15. The device of claim 12 wherein said handle is a hollow tube-like elongated member and said pressure rod and a spring are located therein and said rod is spring biased with pressure on said pressure rod in a direction toward said frame.

16. The device of claim 15 wherein said rod is connected to said pressure rod adjustment means so that said means may be rotated in a first direction to move said rod away from said base frame and may be rotated in an opposite direction to move said rod toward said base frame.

17. The device of claim 12 wherein said anilox roll is mounted within expanded slots of said sideframes so as to be moveable therein along a line parallel to a line of movement of said pressure rod.

18. The device of claim 12 wherein at least one of said side frames is removably attached to said base frame.

* * * * *